United States Patent [19]

Momono

[11] Patent Number: 4,489,891

[45] Date of Patent: Dec. 25, 1984

[54] ELECTROMAGNETIC FUEL INJECTOR

[75] Inventor: Masakichi Momono, Katsuta, Japan

[73] Assignee: Hitachi, Ltd., Tokyo, Japan

[21] Appl. No.: 394,641

[22] Filed: Jul. 1, 1982

[30] Foreign Application Priority Data

Jul. 2, 1981 [JP] Japan ..... 56-104235

[51] Int. Cl.[3] ..... B05B 01/30

[52] U.S. Cl. ..... 239/585

[58] Field of Search ..... 239/585, 406

[56] References Cited

U.S. PATENT DOCUMENTS

| | | | |
|---|---|---|---|
| 3,721,390 | 3/1973 | Jackson | 239/585 |
| 4,179,069 | 12/1979 | Knapp et al. | 239/585 X |
| 4,218,021 | 8/1980 | Palma | 239/585 |
| 4,264,040 | 4/1981 | Saito | 239/585 |

*Primary Examiner*—John J. Love

*Assistant Examiner*—Mary F. McCarthy

*Attorney, Agent, or Firm*—Antonelli, Terry & Wands

[57] ABSTRACT

An electromagnetic fuel injector for internal combustion engines comprises a yoke containing a coil and cores; a cylinder secured to the yoke and therein forming a nozzle, a valve seat, a valve guide bore, and a plurality of fine fuel passages formed between the valve seat and the termination of the valve guide bore; a ball valve connected to a plunger with flange and inserted slidably in said valve guide bore; a holder of a dense material mounted at one end on the cylinder with a little gap therebetween and with a O-ring being pressed in the radial direction, and secured fluid-tightly at the other end to the yoke thereby to define an annular fuel reservoir around the cylinder. A pair of fuel pipes are connected to the holder. Further, a cap is mounted in the front of the holder to jet fuel from the nozzle whereby fuel is atomized.

5 Claims, 4 Drawing Figures

ELECTROMAGNETIC FUEL INJECTOR

BACKGROUND OF THE INVENTION

This invention relates to an electromagnetic fuel injector, and, more particularly to an electromagnetic fuel injector for internal combustion engines, which includes a valve through which fuel is fed from between a valve seat and an end portion of a bore for guiding the valve.

Various types of electromagnetc fuel injectors are known, and, for example, in U.S. Pat. No. 4,218,021, a fuel injector is proposed which employs a ball valve which is permitted to move relatively and perpendicularly to the movement of a plunger connected to the ball valve, with the plunger being actuated by a solenoid means so that the ball valve aligns with a valve seat. In a normal operation, the ball valve moves while out of contact with the plunger. A disadvantage of this proposed construction resides in the fact that many components are required for constructing such an injector mechanism. In the fuel injector shown in FIG. 1 of the patent, a fuel passage to the valve seat is composed of holes made in a body forming a solenoid case portion and a nozzle case portion, a pair of pipes connected to the holes, and a space surrounding the ball valve and a plunger. In the fuel injector shown in FIGS. 2 and 4 of the patent, part of the fuel passage is formed of a throttle body and a manifold, the material of which is, in many cases cast, and such cast products are required not to include porous portions therein.

In an electromagnetic fuel injector having a seat valve and a ball valve which is slidably inserted in a bore and guided by the bore to align with the valve seat, it is preferable that fuel passages are formed in a member, defining the valve seat and the bore, between the valve seat and a bore end portion or a position at which the ball valve contacts the wall of the bore when the ball valve rests on the valve seat. The fuel passages extend from the inside out of the member through the wall portion of the ball valve. The fuel passages are small in diameter so that their length is preferably short and provide a large fuel reservoir communicating with the fuel passages.

An object of the invention is to provide an electromagnetic fuel injector which has a seat valve, a ball valve, slidably inserted in a bore and guided by the bore to align with the valve seat, and a plurality of fuel passages formed in a member, defining the bore, between the valve seat and a bore end portion, and which is provided with a relatively large fuel reservoir formed around the fuel passages by a hollow holder of dense metal material which is fluid-tightly mounted which ensures, without fail the alignment of the valve seat and the ball valve, and with easy operation.

A feature of the invention is that the hollow holder is mounted fluid-tightly at one end on the member, which defines therein the valve seat and the valve guide bore and which is secured to a valve actuating means, by being loosely inserted by the member, and at the other end, fluid-tightly secured to the valve actuating means. It is preferable that O-rings are used at both the ends of the holder such that the O-rings are pressed substantially at right angles in different directions. Further it is preferable that the valve actuating means and the member secured to the means are loosely inserted in the holder and part of the holder is deformed to extend about a peripheral portion of the valve actuating means, whereby mounting operation of the holder is facilitated.

DETAILED DESCRIPTION

Figure 1:
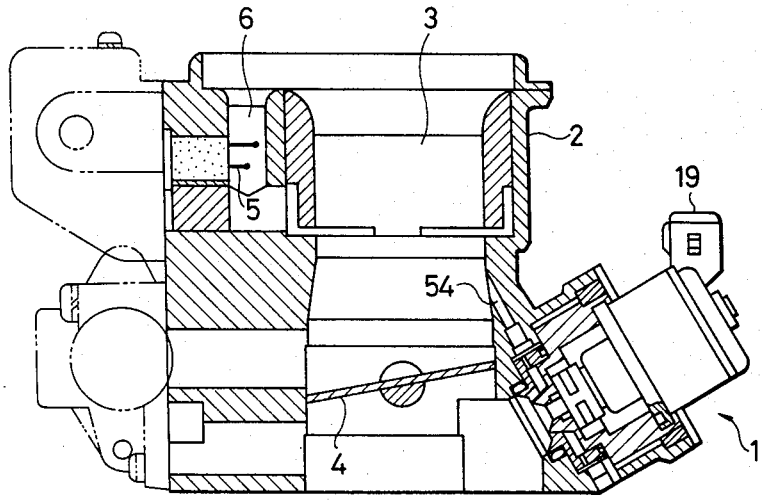
FIG. 1 is a sectional view of a throttle body employing an embodiment of an electromagnetic fuel injector according to the invention.
Figure 2:
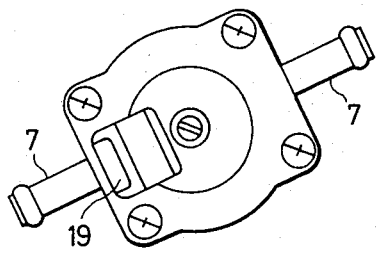
FIG. 2 is a perspective view of the fuel injector of FIG. 1.

In FIGS. 1 and 2, the electromagnetic fuel injector generally designated by the reference numeral 1 is mounted on a throttle body 2 or an engine manifold (not shown) and used to feed fuel to the engine. The throttle body 2 has an air induction passage 3, a throttle valve 4, and a means 5, provided in a bypass 6, for measuring the quantity of air to be fed to the engine. The fuel injector 1 is mounted on the throttle body 2 near the throttle valve 4 and injects fuel into the induction passage 3 downstream of the throttle valve 4 in dependence upon the quantity of air being measured. Fuel fed the fuel injector 1 is supplied from a pair of fuel pipes 7, which are connected to a fuel tank (not shown), and through which fuel pressurized about 2.7 ata is circulated.

Figure 3:
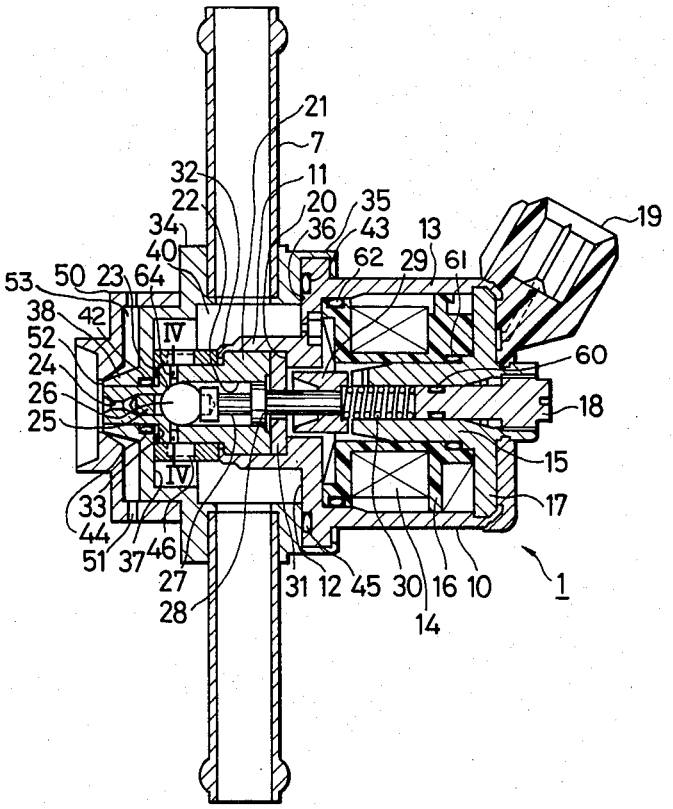
FIG. 3 is a sectional view of the electromagnetic fuel injector shown in FIGS. 1 and 2.
Figure 4:
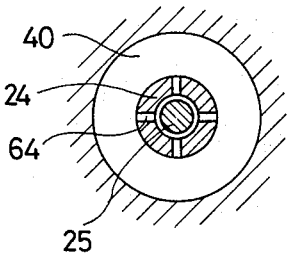
FIG. 4 is a sectional view taken along a line IV—IV of FIG. 3.

In FIG. 3, a yoke 10, which serves as a housing and a part of magnetic circuit, outwardly a sleeve 11, a flange 12 extending radially and from one end of the sleeve 11 with the flange 12 including an O-ring retaining groove 43 in a radially flat portion thereof. A cylindrical wall 13 of the yoke 10 extends axially from the flange 12 in the opposite direction to the sleeve 11. A coil 14, wound on a bobbin 16, is inserted into the cylindrical wall 13. A core 15, with a flange 17, is inserted in a bore of the bobbin 16, and the flange 17 presses the bobbin 16 on the flange 12 of the yoke 10 and is fixed by deforming the end of the cylindrical wall 13 of the yoke 10. The core 15 has a bore in the center thereof for accommodating an adjustment screw 18. A connector 19 with terminal leads is provided on the end portion of the yoke 10, and the terminal leads are electrically connected to the coil 14.

The sleeve 11 of the yoke 10 is formed as a stepped bore with shoulder 20, wherein valve and nozzle means is fixed. A cylinder member 21, formed in an axially stepped configuration, is provided with a precisely finished axially extending bore 22 opened at one end, a conical valve seat 23 near the termination of the bore 22, a plurality of radially extending fine fuel passages 64 disposed between the valve seat 23 and the end of the bore 22, a nozzle 24 at the end of the cylinder member 21, and a swirler 25 disposed between the nozzle 24 and the valve seat 23. The conical valve seat 23 and the bore 22 are disposed in alignment with each other. The swirler 25 is a cylinder with inclined or helical fine grooves formed thereon. A ball valve 26 is inserted in the bore 22; which is connected to one end of a plunger 27 with the plunger 27 having a flange 28 substantially in the middle thereof. The other end of the plunger 27 is provided with a movable armature 29 secured thereto by a pin (not shown), with the armature 29 faces the end of the fixed core 15 and being urged leftward by a compression spring 30 so that the ball valve 26 rests on the valve seat 23 when the coil 14 is not energized. An outer configuration of the cylinder 21 is reduced in diameter in stepwise fashion in a direction toward the nozzle 24 to form two shoulders 32, 33 and encloses the plunger 27 with the ball valve 26, with the cylinder 21 being inserted into the sleeve 11 together with a spacer 31 which is formed with a U-shaped bore, pressed on the shoulder 20, and secured to the yoke 10 by deforming the end of the sleeve at the shoulder 32 of the cylinder member 21.

In this construction, both the ball valve 26 and the flange 28 of the plunger 27 are guided by the inner wall defining the bore 22 of the cylinder member 21, so that the ball valve 26 is precisely aligned with the conical valve seat 23. Therefore, the ball valve 26 not only surely blocks the fuel passage made in the valve seat 23 when the ball valve 26 rests on the valve seat 23, but provides even clearance between the valve seat 23 and the ball valve 26 when the ball valve 26 is kept apart from the seat 23 to form a fuel passage therebetween.

A holder 34, which defines an annular fuel reservoir 40 around the cylinder member 21 and the sleeve 11, has a stepped cylindrical configuration to provide a large diameter cylindrical wall 35, radially flat portions 36, 37, and a small diameter portion 38 with an annular groove 42. The fuel pipes 7 are inserted into bores made in the holder 34 between the radially flat portions 36, 37, and secured to the holder 34 by brazing or welding. The holder 34 with the pipes 7 is fitted by insertion on the assembly of the nozzle and valve means and a solenoid mean including the yoke 10, the coil 14, the core 15, etc. Namely, the cylindrical wall 35 and the small diameter portion 38 are mounted on the cylinder member 21 at the flange 12 and the nozzle portion of the yoke 10, and the axial end of the cylindrical wall 35 is deformed around the peripheral portion of the flange 12, so that the radially flat portion 36 of the holder 34 is pressed on the flange 12, with an O-ring 45 deformed axially. The other radially flat portion 37 is kept apart from the shoulder portion 33 of the yoke 11, for example, by about 1 mm and the small diameter portion 38 also is kept a little apart from the outer surface of the nozzle portion 24 while an O-ring 44 is substantially deformed in the radial direction.

The holder does not deform the cylinder 21 because the holder applies force on the cylinder member 21 only through the O-ring 44. Therefore, the valve seat 23 is kept in alignment with the ball valve 26 and the plunger 27. The holder 34 is made of dense or fuel impermeable metal material such as rolled or press-formed copper, so that fuel does not leak from the holder 34. Further, sealing between the holder 34 and the yoke 10 and cylinder member 21 is effected by the two O-rings 44 and 45 one of which is pressed in the direction different from the pressing direction of the other O-ring by right angles so that the sealing effects by the two O-rings are independent from each other and a sure sealing effect can be obtained.

An annular fuel filter 46 is fitted on the cylinder member 21 to face the fuel passages 64 and restricted axially by the radially flat portion 37 and the shoulder 32 of the cylinder member 21. The filter 46 is fitted before assembling the holder 34, and is fixed only by assembling of the holder 34.

On the outer front of the holder 34, a cap 50, which has an outer cylindrical wall with fine holes 51 and a central bore 52, is mounted and secured by press-fit, brazing after press-fit, or the like. The cap 50 defines an air chamber 53 in cooperation of the front portion of the holder 34, which chamber 53 communicates with the induction passage 3 through the holes 51 and a bypass 54 bypassing the throttle valve portion. The central bore 52 is coaxial with the front outer surface of the holder 34 so as to define an annular air outlet communicating with the air chamber 53.

In this construction of the fuel injector, when the coil 14 is energized magnetic force is applied between the movable armature 29 and the fixed armature 15, and the movable core 29 is attracted to the fixed core 15 against the spring 30 so that the plunger 27 with ball valve 28 is moved toward the fixed core 15, and the ball valve 26 is kept apart from the valve seat 23. Fuel pressurized and circulated in the fuel pipes 7, the fuel reservoir 40 and a tank is injected into the induction passage 3 or through the filter 46, the fuel passages 64, the swirler 25, and the nozzle 24 while being swirled by the swirler 25. The injected fuel spreads conically and is atomized. Air from the induction passage 3 is annularly jetted from the annular air outlet so that atomization and gasification of the fuel injected from the nozzle are promoted.

Therefore, a fuel-air mixture fed the induction passage 3 downstream of the throttle valve 4 by the fuel injector is gasified more, and even if it is in state of liquid droplets their size is very small, so that the mixture can be distributed evenly to each cylinder of the engine.

When the coil is de-energized, electromagnetic force disappears, as a result, the ball valve 26 rests on the valve seat 23, with the plunger 27 being urged in a leftward direction by the spring 30, so that fuel from the fuel reservoir 40 is interrupted to flow into the induction passage 3.

Sealing in the solenoid means is effected by three O-rings 60, 61, and 62 so that fuel in the fuel reservoir 40 does not leak out of the solenoid means.

What is claimed is:

1. An electromagnetic fuel injector for internal combustion engines, the electromagnetic fuel injector comprising:

valve actuating means for electromagnetically actuating valve means, said actuating means including a coil, a movable armature, and a yoke containing said coil and said movable armature;

an axially extending member secured to said yoke, said member forming therein a valve seat portion with a central hole at a center thereof, an axially extending valve guide bore, a plurality of fine fuel passages positioned between said valve seat portion and one end of said valve guide bore, and a nozzle portion communicating with said fine fuel passages through said central hole;

a ball valve contained in said valve guide bore of said member and mechanically connected to said movable armature so as to be permitted to selectively rest on said valve seat portion and be kept away therefrom in accordance with an operation of said valve actuating means;

an axially extending holder means formed of a dense metal material for holding a pair of fuel pipes and for defining a fuel reservoir communicating with said pair of fuel pipes, said holder means having a small diameter portion mounted on said member with a small gap therebetween, and a large diameter portion which has a radially extending flat portion abutting on a flange portion radially extending from a periphery of said yoke and a cylindrical portion projecting axially from said radially extending flat portion enclosing a periphery of said flange portion of said yoke, an end of said cylindrical portion is deformed so as to secure said cylindrical portion to said yoke;

a first O-ring disposed between said member and said small diameter portion of said holder means, said first O-ring being adapted to be pressed in a radial direction; and a second O-ring disposed at an abutment between said yoke and said holder means, said second O-ring being adapted to be pressed in an axial direction.

2. The electromagnetic fuel injector as defined in claim 1, further including a swirler means inserted in a fuel passage between said nozzle and said valve seat for swirling fuel passing therethrough, and a cap means provided on the front of said holder means for jetting annular air to fuel injected from said nozzle.

3. The electromagnetic fuel injector, as defined in claim 1, wherein said ball valve is mechanically connected to said movable core through a plunger with a flange, and said ball valve and said flange of said plunger are inserted in and guided by said member with a distance spaced therebetween.

4. The electromagnetic fuel injector as defined in claim 3, wherein said yoke has a sleeve projecting in an opposite direction to the portion containing said coil, said member having a shoulder formed thereon and being inserted in and secured to said sleeve by deforming an end portion of said sleeve.

5. An electromagnetic fuel injector for internal combustion engines comprising:

a yoke having a sleeve portion, a flange portion extending radially from one end of said sleeve portion, and a first cylindrical wall axailly extending from a peripheral portion of said flange portion;

a coil and bobbin contained in said first cylindrical wall of said yoke;

a fixed core inserted in said coil and having a flange secured to said first cylindrical wall;

a hollow cylinder member having a stepped configuration to provide shoulder portions on the outer surface, said hollow member being inserted, at one end, in said sleeve portion and secured to said yoke by a deformation of one end of said sleeve portion at one of said shoulder portions, and said member having a nozzle portion, a valve seat portion, an axial bore for guiding a valve, and a plurality of fine fuel passages formed between said valve seat portion and a termination of said axial bore;

a ball valve mechanically connected to a plunger with a flange slidably inserted in said axial bore so as to selectively rest on said valve seat portion and be kept away therefrom in dependence upon an operating condition of the fuel injector;

a movable armature connected to said plunger and facing said fixed core so that said movable armature is electromagnetically attracted to said fixed core by energizing said coil;

a cylindrical holder means of a dense metal material for defining an annular fuel reservoir around said hollow member and for holding a pair of fuel pipes, said holder means having a smaller diameter portion mounted on said hollow member with a small gap therebetween, and a large diameter portion which has a radially extending flat portion abutting axially on said flange portion of said yoke, and a second cylindrical wall projecting axially from said radially extending flat portion, enclosing a periphery of said flange portion of said yoke, and deformed at the end of said second cylindrical wall to be secured to said yoke;

O-rings, one of which is disposed between said hollow member and said small diameter portion of said holder means and pressed radially, and the other disposed and axially pressed at said abutment between said yoke and said holder means;

a swirler means disposed in a fuel passage of said hollow member between said nozzle portion and said valve seat portion; and a cap mounted in the front of said holder means for jetting air into fuel jetted from said nozzle portion.

* * * * *